US006561509B2

(12) United States Patent
Kettenmann et al.

(10) Patent No.: US 6,561,509 B2
(45) Date of Patent: May 13, 2003

(54) MONITORING APPARATUS FOR THE SHEET FEED TO A SHEET-PROCESSING MACHINE, AND METHOD OF MONITORING THE SHEET STREAM STRUCTURE/THE SHEET STREAM

(75) Inventors: Peter Kettenmann, Waghäusel (DE); Hans Butterfass, Heidelberg (DE); Carsten Huschle, Bretten (DE); Robert Müller, Mörlenbach (DE); Thomas Wolf, Karlsruhe (DE); Martin Reuter, Dachau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/903,355

(22) Filed: Jul. 11, 2001

(65) Prior Publication Data

US 2002/0060420 A1 May 23, 2002

(30) Foreign Application Priority Data

Jul. 11, 2000 (DE) ..... 100 33 638

(51) Int. Cl.[7] ..... B65H 7/02

(52) U.S. Cl. ..... 271/263; 271/262; 271/258.01; 271/258.05; 271/265.04

(58) Field of Search ..... 271/256, 258.01, 271/259, 262, 263, 258.05, 265.01, 265.04

(56) References Cited

U.S. PATENT DOCUMENTS 4,560,159 A * 12/1985 Staub ..... 192/127
4,753,433 A * 6/1988 Rodi et al. ..... 271/151
4,955,598 A * 9/1990 Hiroshige et al. ..... 198/769
4,997,177 A * 3/1991 Mori et al. ..... 271/267
5,249,795 A * 10/1993 Nishimoto ..... 271/265.02
5,443,257 A * 8/1995 Sakamori ..... 271/228
6,065,746 A * 5/2000 Tranquilla ..... 193/32
6,112,660 A 9/2000 Junghans et al.
6,229,139 B1 * 5/2001 Neukermans et al. ..... 250/236

FOREIGN PATENT DOCUMENTS

| | | | |
|---|---|---|---|
| DE | 34 19 436 A1 | | 12/1984 |
| DE | 37 30 683 A1 | | 3/1989 |
| DE | 44 36 102 A1 | | 4/1996 |
| DE | 196 46 511 C1 | | 5/1998 |
| EP | 0 242 622 B1 | | 10/1987 |
| JP | 1-127543 | * | 5/1989 |

* cited by examiner

*Primary Examiner*—Patrick H. Mackey
(74) *Attorney, Agent, or Firm*—Laurence A. Greenberg; Werner H. Stemer; Gregory L. Mayback

(57) ABSTRACT

A method is proposed for measuring thickness and detecting double and missing sheets during the sheet feed to a sheet-processing machine, such as a sheet-fed printing machine. A corresponding monitoring apparatus has one or more sensing elements above or beneath the sheet stream. The sensing element can be displaced, with an actuating device having an actuating drive, in the direction towards and away from the sheet stream. The actuating drive has at least one piezoelectric actuator or it is formed by the latter.

28 Claims, 4 Drawing Sheets

CONTROL DEVICE
18
11
37
39
1
3
5
7
8
9
11
13
15
17
19
21
23
25
27
29
31
33
35
37
39
41
II – II
III – III
X

MONITORING APPARATUS FOR THE SHEET FEED TO A SHEET-PROCESSING MACHINE, AND METHOD OF MONITORING THE SHEET STREAM STRUCTURE/THE SHEET STREAM

BACKGROUND OF THE INVENTION

Field of the Invention

The invention relates to a monitoring apparatus for the sheet feed to a sheet-processing machine (e.g., a sheet-fed printing machine), in particular overlapping sheet feed. The monitoring apparatus has at least one sensing element which is disposed above or beneath the sheet stream and, by means of an actuating device having an actuating drive, can be displaced in the direction of the sheet stream and in the opposite direction. The invention further relates to a method of monitoring the sheet stream structure or the sheet stream during its transport into a sheet-processing machine, wherein at least one sensing element can be displaced in the direction of a back-pressure element, over which the overlapping sheet stream or the sheet stream having individual sheets is guided.

U.S. Pat. No. 4,753,433 (European patent EP 0 242 622 B1) describes a monitoring apparatus of the type mentioned here which has a sensing roller which is arranged above a feeder table and can be displaced in the direction of the feeder table with the aid of an electric stepping motor. Coupled to the sensing roller is a sensor which always transmits a signal to a control device when at least two sheets overlap each other. It has been shown that the monitoring apparatus can be used only to a limited extent and, in the cases wherein dynamic and very precise displacement of the sensing roller is required, cannot be used, among other things because of the relatively sluggish stepping motor.

SUMMARY OF THE INVENTION

The object of the present invention is to provide a monitoring apparatus which overcomes the above-noted deficiencies and disadvantages of the prior art devices and methods of this general kind, and to provide a method of monitoring the sheet stream wherein high functional reliability can be ensured.

With the above and other objects in view there is provided, in accordance with the invention, a monitoring apparatus for the sheet feed to a sheet-processing machine wherein a stream of sheets travel in a given sheet stream direction, comprising:

- at least one sensing element disposed adjacent (i.e., above and/or underneath) the sheet stream;
- an actuating device connected to the sensing element and configured to selectively displace the sensing element towards and away from the sheet stream, the actuating device having an actuating drive for displacing the sensing element, the actuating drive including at least one piezoelectric actuator (i.e., it is has or is formed by the piezoelectric actuator).

In other words, the apparatus has one or more sensing elements which is/are arranged above or beneath a sheet stream and can be moved in the direction of the sheet stream and away from the sheet stream by means of an actuating drive. The monitoring apparatus is distinguished by the fact that the actuating drive has at least one piezoelectric actuator or is formed by the latter. With the aid of the piezoelectric actuator, dynamic, that is to say very fast and precise, displacement of the sensing element is possible, which may be necessary in specific monitoring operations.

In a particularly advantageous exemplary embodiment of the monitoring apparatus, the piezoelectric actuator is constructed as described in German patent DE 196 46 511 C1 of the company marco Systemanalyse und Entwicklung GmbH. The disclosure content with regard to the construction and the function of the piezoelectric actuator of the German patent is herewith incorporated by reference. The piezoelectric actuator has a basic element which has a stack structure built up from ceramic lamellae layers.

By means of appropriate electrical driving of the piezoelectric actuator the latter can be pivoted or tilted about an axis lying at the area center of gravity of the basic element, so that the sensing element, directly or with the interposition of a transmission mechanism, can be displaced in the direction of the sheet stream or, respectively, of a support over which the sheet stream is transported, and in the opposite direction.

Further advantageous exemplary embodiments of the monitoring apparatus emerge from the dependent claims.

With the above and other objects in view there is also provided, in accordance with the invention, a method of monitoring a sheet stream structure or a sheet stream being transferred into a sheet-processing machine, which comprises:

- transporting a stream of sheets across a back-pressure element and towards a sheet-processing machine;
- displacing at least one sensing element in a direction towards the back-pressure element over which the stream of sheets is guided in the form of an overlapping sheet stream or a sheet stream having individual sheets;
- detecting, with the sensing element set against the sheet stream, the sheet stream as it is transferred into the sheet-processing machine; and
- thereby displacing the sensing element with respect to the sheet stream in dependence on an instantaneous sheet stream thickness such that a pressing force with which the sensing element is pressed against the sheet stream is maintained within a predefined range.

In other words, in order to monitor the sheet stream structure or the sheet stream during its transport into a sheet-processing machine, at least one sensing element can be displaced in the direction of a back-pressure element, over which the overlapping sheet stream or the sheet stream having individual sheets is guided, that is to say transported. The method is distinguished by the fact that the sensing element is set against the sheet stream, that is to say pressed on with a defined force, and detects the sheet as it is transferred into the machine, for example a sheet-fed printing machine. During the monitoring of the sheet stream, the sensing element is always displaced with respect to the sheet stream as a function of the respective instantaneous sheet stream thickness in such a way that the pressing force with which the sensing element is pressed against the sheet stream is kept at a predefinable value or within a predefinable value range. By means of a suitable sensor system, the travel is determined by which the sensing element is displaced with respect to the preferably stationary back-pressure element, for example formed by a feeder table. In this way, the thickness of the sheet stream can be determined or measured very exactly, so that double and missing sheets can readily be detected, which, for example, leads to the output of a fault signal. In addition, by means of the change in the distance of the sensing element with respect to the back-pressure element, including the respective instantaneous machine speed, premature, delayed and skewed sheets can also be detected. The method is distinguished by high accuracy and, in addition, exhibits high functional reliability. Moreover, it is particularly advantageous that, because of the pressing force of the sensing element on the back-pressure element being kept constant, the measuring conditions are constant, irrespective of the respective sheet stream thickness. Automation of the sheet thickness measurement or the sheet stream thickness measurement and/or the sheet stream monitoring is therefore readily possible.

In an advantageous exemplary embodiment of the method, provision is made for the pressing force of the sensing element against the sheet stream to be monitored and, in the event of the pressing force falling above or below a limiting value, for a fault signal to be triggered which, for example, leads to a visual display of a fault or directly to the machine being stopped.

According to another design variant, the distance between the sensing element and the back-pressure element is monitored by the relative movement of the sensing element with respect to the back-pressure element being measured/monitored in order to set a constant pressing force, it being possible here, too, for a fault signal to be output as soon as the distance between the sensing element and the back-pressure element falls above a specific upper limiting value or below a specific lower limiting value. This means that if, for example, a double sheet occurs within the sheet stream, so that at this point the thickness of the sheet stream is impermissibly increased, the sensing element will be moved so far away from the back-pressure element, with the aid of a suitable, preferably dynamic, actuating drive, that the pressing pressure of the sensing element against the sheet stream remains at a constant value. In this case, however, if the sensing element is moved beyond a maximum permissible distance from the back-pressure element, a desirable message is provided in the form of a signal.

There is also provided, in accordance with the invention, a method of monitoring a sheet stream structure or a sheet stream being transferred into a sheet-processing machine, which comprises:

- transporting a stream of sheets across a back-pressure element and towards a sheet-processing machine;
- displacing at least one sensing element in a direction towards the back-pressure element over which the stream of sheets is guided in the form of an overlapping sheet stream or a sheet stream having individual sheets;
- detecting a sheet stream structure with the sensing element in contact at a start of the sheet transfer;
- determining a height profile of the sheet stream from information obtained in the sheet stream detecting step;
- setting the sensing element away from the sheet stream and, during a further transfer of the sheet stream, continuously displacing the sensing element in the direction of the sheet stream and in the opposite direction such that a clear spacing between the sensing element and the sheet stream is substantially constant; and
- if a fault in the sheet stream is detected, outputting a fault message.

In other words, in order to monitor the sheet stream structure or the sheet stream during its transfer into a sheet-processing machine, provision is made firstly for the structure of the overlapping sheet stream or the sheet stream having individual sheets to be detected, that is to say it is determined how the sheet stream thickness changes. To this end, in a preferred embodiment, at the start of the sheet transfer, firstly the sensing element is set against the back-pressure element, that is to say brought into contact and pressed on with a defined force, in order for example to set the zero point and to determine the machine oscillations. The sheet stream is then transported into the nip formed between the back-pressure element and the sensing element, so that the sensing element is then pressed against the sheet stream with a preferably defined, in particular constant, force. Detection of the sheet stream with contact by the sensing element therefore takes place. From the information determined by the sheet stream detection, with the aid of a suitable device, for example a control and regulating device, the contour height profile of the sheet stream is determined. The sheet stream height profile is determined by the different thickness of the sheet stream, which may be overlapping and or have individual sheets arranged at a distance from one another. After the height profile has been determined, the sensing element is set away from the sheet stream, that is to say spaced apart from the sheet stream, and during the further transfer of the sheet stream, is always displaced in the direction of the sheet stream and in the opposite direction, that is to say away from the sheet stream, in such a way that the clear spacing between the sensing element and the sheet stream is constant or substantially constant. The sensing element therefore travels over the sheet stream structure without contact, the displacement movement of the sensing element for setting the constant spacing of the sensing element from the sheet stream being carried out as a function of the machine speed.

The clear spacing between the sensing element and the sheet stream is so small that, if there is a double sheet in the sheet stream, contact occurs between the double sheet and sensing element. This "collision" can be determined in various ways, for example by determining the force exerted by the double sheet in the event of contact between the latter and the sensing element. After the double sheet has been detected, constituting a fault in the sheet stream, a fault message is output, which, for example, leads directly to the machine being stopped. Further faults in the sheet stream are premature and delayed sheets, which therefore arrive too early or too late at the sensing element, counter to the idealized sheet stream determined by the height profile, and are therefore detected as premature or delayed sheets on the basis of the time of their contact with the sensing element, which can readily be monitored by means of a suitable device. Using this method of monitoring the sheet stream, although no missing or skewed sheets can be detected, this method has the advantage that on account of the essentially non-contacting detection of the sheet stream—except at the beginning of the sheet stream transport—marking of the sheets can be ruled out. The method can therefore be particularly advantageously used in the case of very sensitive sheets.

In a preferred embodiment of the method, the sensing element is displaced in an oscillatory manner as a function of the machine speed, in order to monitor the sheet stream without contact for double or multiple sheets. To this end, the sensing element arranged above or below the sheet stream is moved linearly or along a circular path section.

In order to be able to ensure a constant spacing between the sensing element and the top of the sheet stream continually, one advantageous exemplary embodiment, wherein the sheet stream has individual sheets spaced apart from another, provides for the sensing element, in a first end position defined by the height profile of a fault-free sheet stream, to dip into every clearance which is formed between a preceding sheet and a sheet following immediately, that is to say it is moved in. If the sheet stream is not fault-free and, for example, has a premature, delayed or skewed sheet, the sensing element is pressed against the sheet stream, which can be determined by means of a sensor system, for example.

In another exemplary embodiment, wherein the sheet stream is overlapped, that is to say at least two sheets partially overlap one another, the sensing element, in a first end position defined by the height profile of the fault-free sheet stream, is moved into every depression in the top of the sheet stream, between the trailing edge of a preceding sheet and the trailing edge of a following sheet. In the case of a double or multiple sheet, the sensing element makes contact with the sheet stream, which leads to a fault indication.

It remains to be recorded that, in the case of this method according to the invention, there is always contact between the sensing element and the sheet stream only when the clear spacing, determined with the aid of the determined height profile of the sheet stream, between the sensing elements located in its first end position and the back-pressure element or the sheet stream is reduced impermissibly on account of a double/multiple sheet or the like.

Other features which are considered as characteristic for the invention are set forth in the appended claims.

Although the invention is illustrated and described herein as embodied in a monitoring apparatus for the sheet feed to a sheet-processing machine, and method of monitoring the sheet stream structure/the sheet stream, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

It will be understood that the apparatus 1 described below can readily be used both for monitoring an overlapping sheet stream and a sheet stream having individual sheets.

Figures 1, 1A:
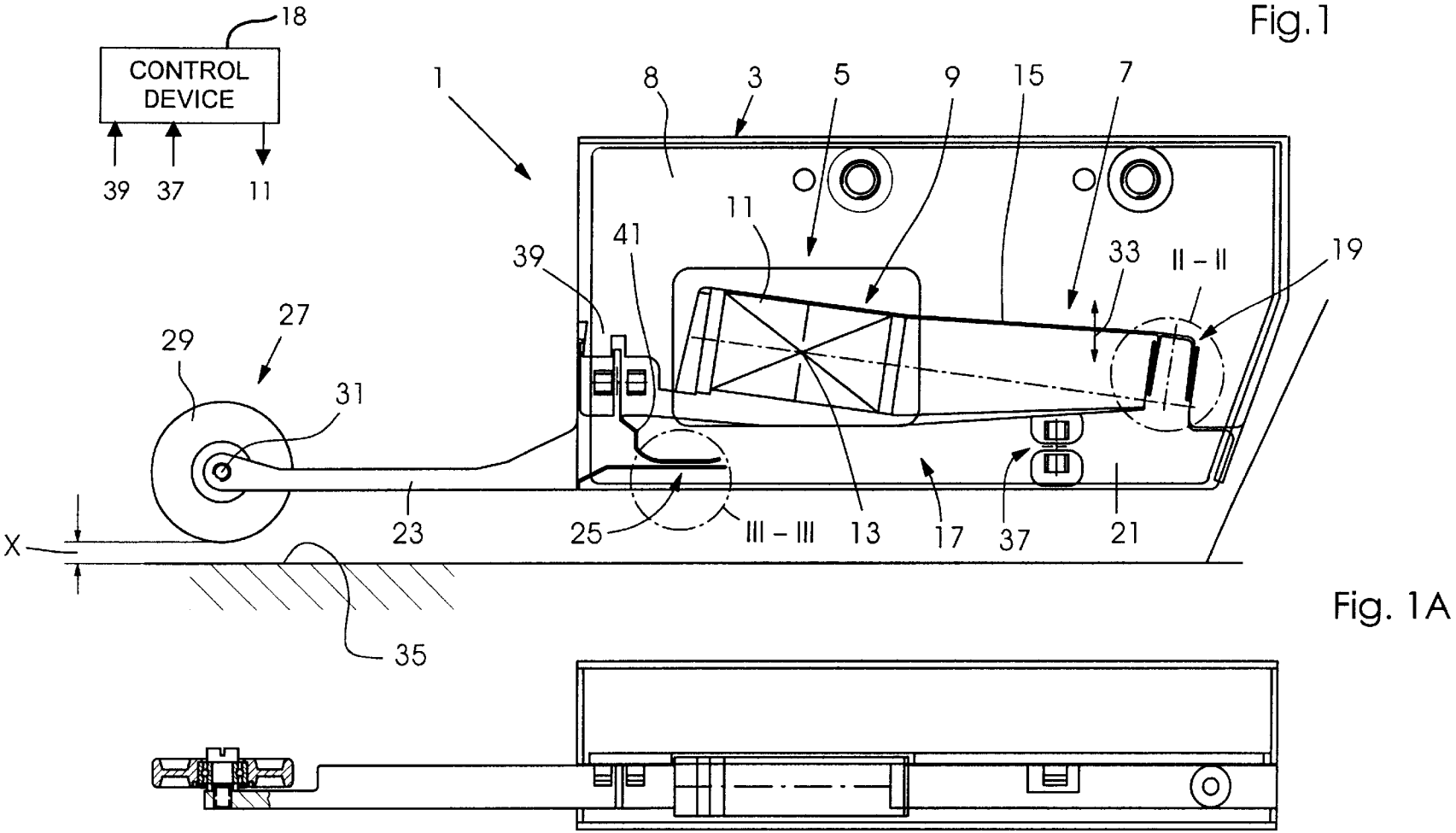
FIG. 1 is a side view of an exemplary embodiment of the monitoring apparatus according to the invention.
FIG. 1A is a sectional view thereof.

Referring now to the figures of the drawing in detail and first, particularly, to FIG. 1 thereof, there is seen an exemplary embodiment of the apparatus 1 for monitoring the overlapping sheet feed to a sheet-processing machine. The latter, which is not illustrated, may be a printing machine or the like. The monitoring apparatus 1 has a rigid carrier 3, which is stationary, i.e., it is arranged in a fixed location, and to which a housing 8 having an actuating device 5 and a lever mechanism 7, serving here as a step-up mechanism, are fitted.

The actuating device 5 has an actuating drive 9, which is formed by a piezoelectric actuator 11. The structure and the function of the piezoelectric actuator 11 is known to those skilled in that art and, accordingly, the description thereof will be kept to a minimum. The piezoelectric actuator 11 has a basic element which is box-shaped here and, by means of appropriate electrical driving, can be tilted in a defined manner about an axis 13 that extends perpendicular into the paper of FIG. 1. The tilting pivot is in the clockwise and counter-clockwise direction. The axis 13 is located at the area center of gravity of the piezoelectric actuator 11.

The lever mechanism 7 has a first lever 15 and a second lever 17, which are coupled to each other via an intermediate joint 19. The second lever 17, formed in one piece, comprises a first part-lever 21 and a second part-lever 23, which are connected to each other by a leaf spring 25. The leaf spring 15 is therefore integrated in the second lever 17. At its end located opposite the leaf spring 25, the first part-lever 21 has the intermediate joint 19. At its end located opposite the leaf spring 25, the second part-lever 23 has a sensing element 27, which here is formed by a sensing roller 29, which is held on the second part-lever 23 so that it can rotate freely about an axis 31.

When the piezoelectric actuator 11 is driven electrically, it is tilted about the axis 13, as a result of which the first lever 15 can be moved upward or downward by a small amount in the direction of the double arrow 33. This movement is transmitted via the intermediate joint 19 to the second lever 17 and, respectively, the first part-lever 21. The transmitted deflection of the first part-lever 21 is passed on via the leaf spring 25 to the second part-lever 23, as a result of which a distance X can be set between the sensing roller 29 and a support 35 which serves as a back-pressure element and, for example, is formed by a feeder table, over which a sheet stream (not illustrated in FIG. 1) is guided in the direction of the sheet-processing machine. Using the piezoelectric actuator 11, the sensing roller 29 can be pressed with a defined force against the support 35 or an individual sheet or overlapping sheet stream transported over said support.

In the exemplary embodiment illustrated in FIG. 1, the monitoring apparatus 1 is arranged above the back-pressure element, that is to say the support 35. In a different exemplary embodiment—not illustrated in the figures—the monitoring apparatus is arranged underneath the back-pressure element. In order to set the sensing roller 29 against the back-pressure element, here the sensing roller 29 has to be displaced upward in a vertical direction, while in the exemplary embodiment illustrated in FIG. 1, the setting movement of the sensing roller 29 is carried out in the vertical direction downward. The back-pressure element is formed here, purely by way of example, by the support 35. In a different, non-illustrated exemplary embodiment, the back-pressure element can also be formed by a roller or roll, a relatively tautly tensioned transport belt or the like.

The monitoring apparatus 1 further has a first sensor system, designed here as an inductive distance measuring system 37, which is assigned to the second lever 17 or the first part-lever 21 and is used for the purpose of registering the position of the second lever 17 relative to the carrier 3 or to the support 35, so that exact positioning of the lever 17, and therefore the setting of the pressing force of the sensing roller 29 against the support 35 or a sheet stream guided/transported over the latter is possible.

Furthermore, a second sensor system designed as an inductive force measuring system 39 is provided, with the aid of which the bending of the leaf spring 25 can be registered. The amount of bending of the leaf spring 25 is thus a measure of the pressing force of the sensing roller 29 onto the support 35 or the sheet or sheets resting or moving across the latter. The pressing force determined by means of the force measuring system 39 is, moreover, a measure of the distance X between the sensing roller 29 and the support 35, since the distance X increases as a function of the number of sheets located between the sensing roller 29 and the support 35, if a measurement is to be carried out with constant force.

The monitoring apparatus 1 also comprises a control and regulating device 18 (open-loop and/or closed-loop control), which has a microcontroller and suitable software. The control device 18 is diagrammatically indicated with a inputs connected to the sensors 37 and 39, and an output connected to the piezoelectric actuator 11. The overlapped structure and the sheet thickness can be automatically determined with the control and regulating device 18.

As a result, independent monitoring of the sheet stream can be carried out. The microcontroller is preferably integrated in the monitoring apparatus 1, that is to say it is fitted in or on the housing 8. Of course, the microcontroller can also be designed as a separate unit, which is arranged at a point remote from the monitoring apparatus 1. As mentioned, the distance measuring system 37 and the force measuring system 39 are connected to the control and regulating device 18. Additionally, the piezoelectric actuator 11 can also be driven electrically by means of the control and regulating device.

The control and regulating device 18, together with the sensing element 27, the actuating drive 9 and the sensor systems 37, 39, forms an intelligent sensor using which double, premature, delayed, skewed and/or missing sheets can be determined and, furthermore, a measurement of the thickness of the sheet stream can be carried out.

Figure 5:
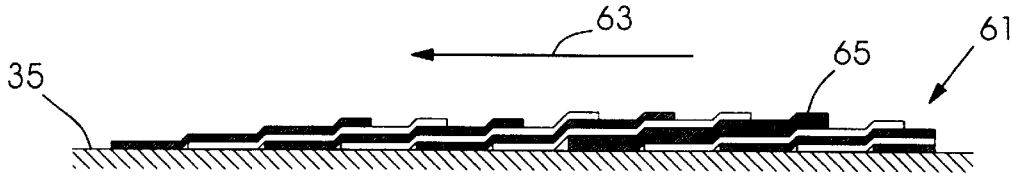
FIG. 5 is a side view of an extract of an overlapping sheet stream, having a double sheet.

The functioning of the monitoring apparatus 1 will be explained in more detail below. Here, it will be assumed that the sensing roller 29 is always displaced by means of the actuating drive 5 and as a function of the instantaneous sheet stream thickness in such a way that the sensing roller 29 is always set against the sheet stream with a constant or substantially constant pressing force. By driving the piezoelectric actuator 11 electrically, the sensing roller 29 is set with a defined force against the sheet stream transported over the support 35. FIG. 5 shows an extract from an exemplary embodiment of the overlapping sheet stream 61, which is transported over the support 35 in the direction of an arrow 63. The sheet stream 61 has a double sheet 65, which here is formed of two sheets sticking to each other. If the sensing roller 29 is pressed against the sheet stream with a defined force and the sheet stream has a fault, for example this double sheet 65, the difference in thickness of the sheet stream is compensated for by a deflecting movement of the sensing roller 29, which is spring-mounted with the aid of the leaf spring 25. The change in the pressing force can be determined with the aid of the force measuring system 39, so that, in order to set a constant pressing force of the sensing roller 29 against the sheet stream, the actuating drive 5, here the piezoelectric actuator 11, is appropriately driven electrically, which leads to the lever mechanism 7 being actuated and therefore to the sensing roller 29 being lifted or—in the case of a missing sheet—being lowered with respect to the support 35. As a result of the "evasive movement" of the sensing roller 29, its distance X from the support 35 is increased beyond a defined, permissible extent, which leads to a fault signal signaling a fault in the sheet stream 61 being output, for example the machine is stopped.

If the sheet stream thickness is suddenly increased considerably, for example on account of a multiple sheet or, for example, if an object gets in between the support 35 and the sensing roller 29, the latter is lifted in the vertical direction by the multiple sheet/the object, as a result of which the second part-lever 23 is forced against a stop 41 on the first part-lever 21. From the stop 41, the force is transmitted to the first part-lever 21, the first lever 15 and the piezoelectric actuator 11. Because of the elasticity of these components, at the same time the position of the first part-lever 21 changes, this positional change being registered by the distance measuring system 37. In the case of small forces, that is to say with only slight bending of the leaf spring 35 without the second part-lever 23 moving against the stop 41, the detection of double/multiple sheets or missing sheets is therefore carried out, as is the thickness measurement of the overlapping sheet formation, using the force measuring system 39.

In the case of this method of monitoring the sheet stream 61, wherein the sensing roller 29 is continually set against the sheet stream with an adjustable, constant pressing force, the detection both of double/multiple sheets and also of missing sheets is readily possible—as described. Furthermore, by using the force measuring system, the thickness of the overlapping sheet formation can also be measured. With the aid of the first sensor system, registration of the displacement movement of the sensing roller 29 in the direction of the support 35 and in the opposite direction, that is to say vertically upward, can also be implemented, so that from this, by including the respective instantaneous machine speed, skewed, premature and delayed sheets can also be detected. The evaluation of the data is also preferably carried out here with the aid of the control and regulating device, which here is accommodated in the housing 8.

The electromechanical monitoring apparatus 1 permits self-teaching, automatic double-sheet detection in the overlapping sheet formation or in a sheet stream having individual sheets. Furthermore, a very small pressing force of the sensing roller 29 against the sheet stream is possible, it being possible to set the latter very quickly and exactly by means of the piezoelectric actuator 11. It remains to be stated that, by using the monitoring apparatus 1, monitoring of a pack, double sheets and thickness can be carried out. In this case, a compact and space-saving design of the monitoring apparatus 1 is possible. The monitoring apparatus 1 also has the advantage that it can also be used for thin sheets. The measurement range of the monitoring apparatus 1 lies preferably in the range from 0 mm to 6 mm. In this case, a very high resolution in the micrometer range can be implemented.

Figure 2:
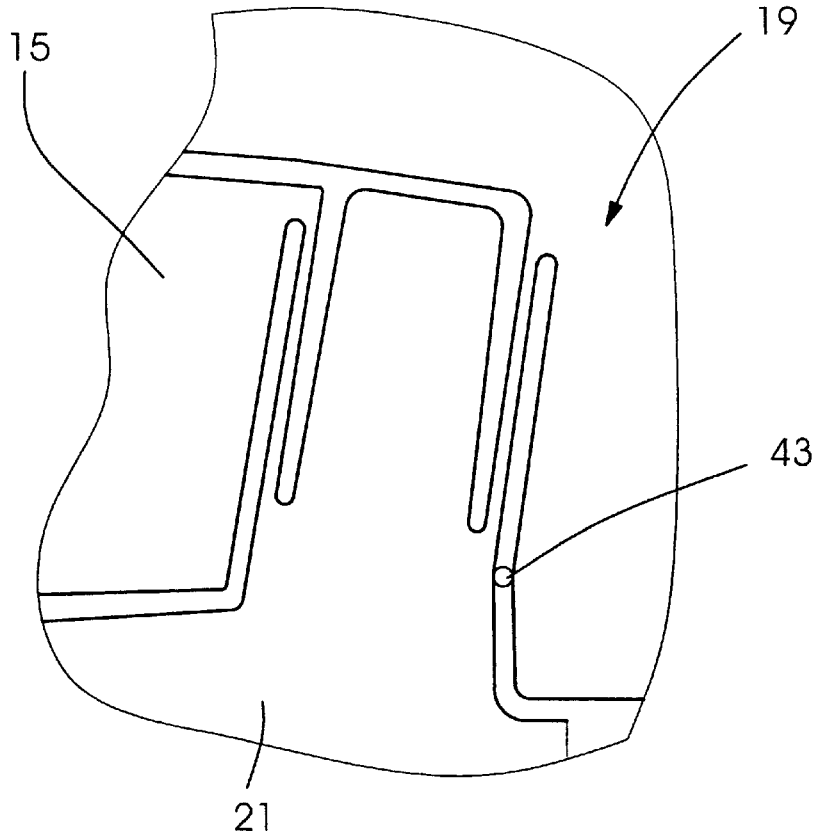
FIG. 2 is an enlarged detail of the dash-outlined area II—II shown in FIG. 1.
Figure 7:
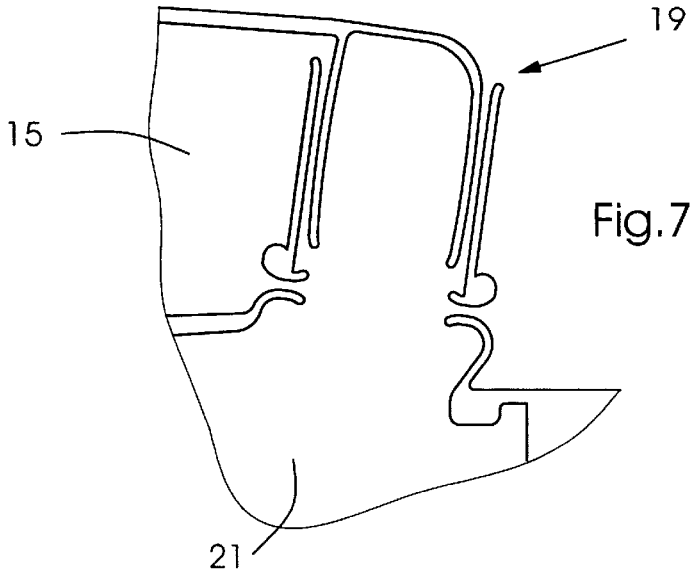
FIG. 7 is a partial side view of a further exemplary embodiment of an intermediate joint in a lever mechanism.

Referring now to FIG. 2, there is shown the intermediate joint 9 between the first lever 15 and the first part-lever 21 much magnified. The intermediate joint 19 has a defined point of rotation 43, about which the first part-lever 21 and, respectively, the second lever 17 is rotated or pivoted with respect to the first lever 15 by driving the piezoelectric actuator 11 electrically. FIG. 7 shows a further exemplary embodiment of the intermediate joint 19.

Figure 3:
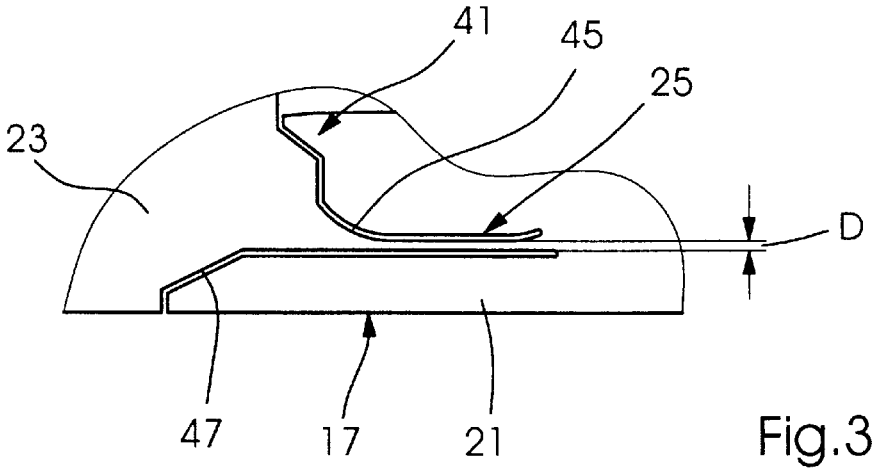
FIG. 3 is an enlarged detail of the dash-outlined area III—III shown in FIG. 1.
Figure 8:
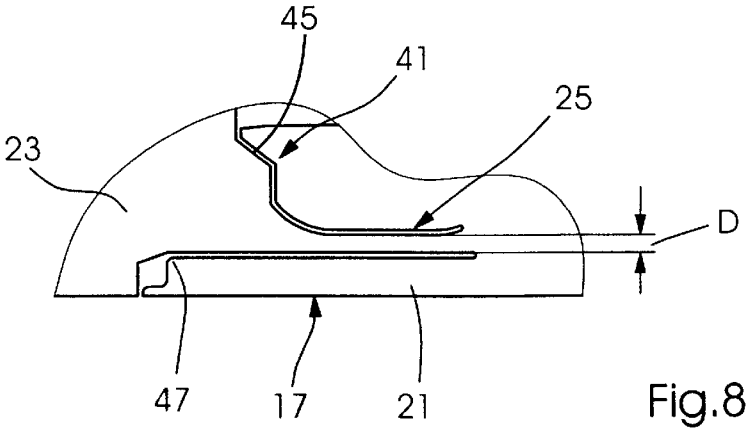
FIG. 8 is a partial side view of a further exemplary embodiment of a leaf spring used as a joint between two part-levers.

Referring now to FIG. 3, there is shown the second lever 17 in the area of the leaf spring 25 on a much enlarged scale. It can be seen that the leaf spring 25 is formed by appropriately shaped incisions 45 and 47 being made in the second lever 17. The leaf spring 25 has a small thickness D, which may be less than 1 mm. FIG. 8 shows a further exemplary embodiment of the leaf spring 25.

Figure 4:
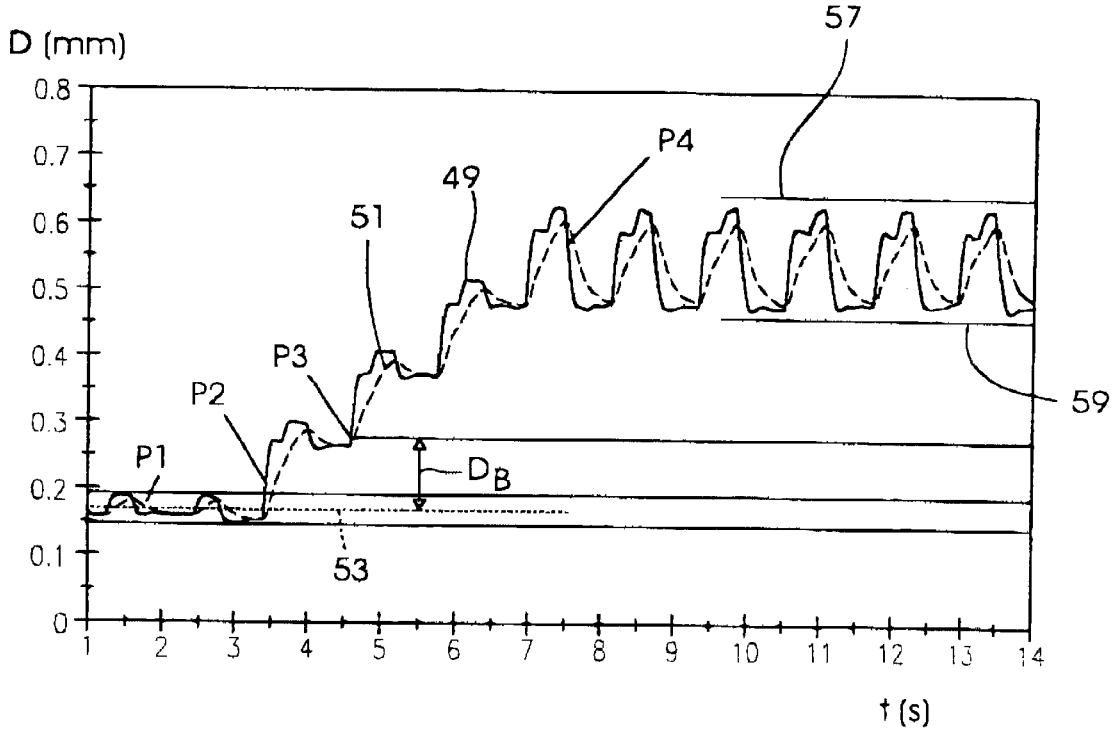
FIG. 4 is a graph plotting the thickness of a sheet stream as a function of time.

FIG. 4 shows a graph wherein the time t (in seconds) is plotted on the x-axis and the thickness D of the layer located between the sensing roller 29 and the support 35, that is to say the distance X between sensing roller and support, is plotted in millimeters on the y-axis. In the graph, a continuous line is used to plot a first signal waveform 49, and a dashed line is used to plot a second signal waveform 51, these showing an unfiltered signal and, respectively, a filtered signal which can be determined with the aid of one exemplary embodiment of the monitoring apparatus 1. In the following text, it will be assumed, purely by way of example, that the monitoring apparatus 1 has a microcontroller and suitable software. In order to be able to carry out monitoring of the sheet stream, it is merely necessary to provide the microcontroller with a starting signal and to input the machine speed. The microcontroller monitors the machine interface and, at the start of the sheet feed, accepts the value for the measured force, that is to say the force with which the sensing roller 29 is pressed against the support 35 or the feeder table. Then, by driving the piezoelectric actuator 11 electrically, the sensing roller 29 is moved against the feeder table surface, to be specific until the force measuring system 39 determines or establishes the predefined pressing force of the sensing roller 29 against the feeder table. Until the first sheet runs in, the zero line 53 and the machine oscillations (P1) are determined. This is carried out here approximately during the first two machine revolutions. In the further course (P2 to P3), the monitoring apparatus 1 determines the sheet thickness $D_B$ and passes this on as thickness information to the control and regulating device of the apparatus 1. The overlapping structure (P4) is then detected. This measurement signal is fed in filtered form to the control and regulating device. If the value falls above or below an upper or lower limit 57 or 59 for the sheet stream thickness, the monitoring apparatus 1 triggers a fault signal. It is clear that even during the build-up of the overlapping formation, a double sheet or a missing sheet can also be detected and output as a fault signal.

With the aid of the monitoring apparatus 1 described using the preceding figures, a further embodiment of the method according to the invention of monitoring the sheet stream structure or the sheet stream can be implemented. In the case of this method, detection of the overlapping structure is carried out first, that is to say the height of the overlapping sheet formation or the number of overlapping sheets within the overlapping formation. To this end, the sensing element 27 is set against the support 35 or the sheet stream at the start of the sheet transfer. The detection of the sheet stream is therefore carried out with contact, the pressing force being kept at a constant value, in particular during the build-up of the overlapping sheet formation. From the information determined by the sheet stream detection, the height profile of the proper sheet stream, that is to say one having no double, packed, missing, premature, delayed and/or skewed sheets, is determined. After the correct height profile of the sheet stream is known, the sensing element is set away from the sheet stream, that is to say, in the case of the exemplary embodiment shown in FIG. 1, it is moved away upward and, during the further transfer of the sheet stream, is always displaced in the direction of the sheet stream and in the opposite direction in such a way that the clear spacing between the sensing element and the sheet stream is preferably constant but at least substantially constant. The cyclic displacement movement of the sensing element relative to the sheet stream is therefore carried out as a function of the course of the contour of the height profile of the fault-free sheet stream and as a function of the machine speed.

Figure 6:
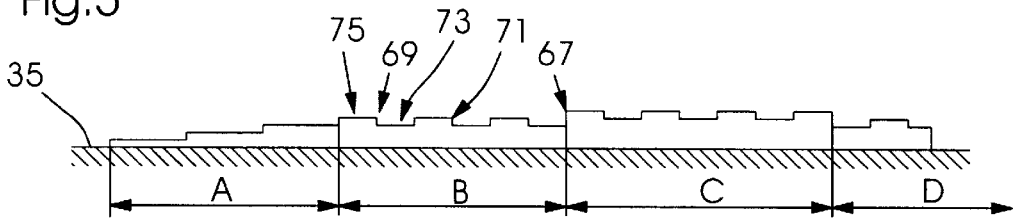
FIG. 6 is a height profile of the extract of the sheet stream shown in FIG. 5.

Referring now to FIG. 6, there is illustrated the height profile 67 of the extract of the sheet stream 61 shown in FIG. 5. In the area of segment A, the sheet stream 61 is being built up, as a comparison with FIG. 5 shows. In the following segment B, the sheet stream 61 has a fault-free, proper height profile. Between a trailing edge 69 of a preceding sheet and a trailing edge 71 of a following sheet in each case, a depression 73 is formed on account of the overlapping of the sheets, into which depression the sensing element dips during its oscillatory upward and downward movement, so that the spacing between the sensing element and the top of the sheet stream is always constant, both in the area of the depression 73 and in the area of the elevations 75, with wherein the sheet stream 61 has its greatest thickness. In the segment C, the double sheet 65 is located here (FIG. 5), as a result of which the sheet stream thickness 61 is thicker here by exactly one sheet thickness than in the segment B and in the segment D following the segment C. Since the oscillatory movement of the sensing element as a function of the fault-free height profile (segments B and D) has been determined, and its approach to the support during the transport of the sheet stream remains constant, in the area of the double sheet 65, the sensing element automatically strikes the sheet stream 61, either when dipping into the depression 73 between two sheets or in the area of the sheet stream wherein the latter has its greatest thickness. As a result of the collision between the sensing element and the sheet stream, a force is exerted on the latter and is determined by means of one of the sensor systems, so that, preferably by means of the microcontroller, a fault message or a fault signal is output, which, for example, leads to the machine being switched off.

it In summary, it remains to be recorded that, with the aid of the apparatus and method according to the invention for controlling the sheet stream which readily result from what has been stated above, a high level of certainty in detecting faults in the sheet stream can be achieved.

We claim:

1. A monitoring apparatus for the sheet feed to a sheet-processing machine wherein a stream of sheets travels in a given sheet stream direction, comprising:

at least one sensing element disposed adjacent the sheet stream;

an actuating device connected to said sensing element and configured to selectively displace said sensing element towards and away from the sheet stream, said actuating device having an actuating drive for displacing said sensing element, said actuating drive including at least one piezoelectric actuator.

2. The monitoring apparatus according to claim 1, wherein said piezoelectric actuator is pivotally supported about a defined pivot axis and configured to pivot upon being electrically driven.

3. The monitoring apparatus according to claim 2, wherein said pivot axis is substantially located at an area center of gravity of said piezoelectric actuator.

4. The monitoring apparatus according to claim 1, which comprises a rigid carrier supporting said piezoelectric actuator and arranged in a fixed location with respect to the sheet stream.

5. The monitoring apparatus according to claim 1, which comprises a lever mechanism coupled to said sensing element and having at least one lever, and wherein said piezoelectric actuator interacts with said lever mechanism.

6. The monitoring apparatus according to claim 5, wherein said lever mechanism has a first lever interacting directly with said piezoelectric actuator, and a second lever carrying said sensing element, and said first and second levers are coupled to each other such that a movement of said piezoelectric actuator is transferred to said sensing element.

7. The monitoring apparatus according to claim 6, wherein said second lever has a first part-lever and a second part-lever, and at least one leaf spring interconnects said first and second part-levers.

8. The monitoring apparatus according to claim 6, which comprises at least one sensor system assigned to said second lever for determining a deflection of said sensing element from a rest position.

9. The monitoring apparatus according to claim 1, which comprises at least one sensor system for determining a deflection of said sensing element from a rest position.

10. The monitoring apparatus according to claim 9, wherein said sensor system is assigned to said first part-lever coupled to said first lever.

11. The monitoring apparatus according to claim 1, which comprises at least one sensor system for determining a bending of the leaf spring.

12. The monitoring apparatus according to claim 7 which comprises a stop, against which said second part-lever coupled to said sensing element strikes when a specific pressing force of said sensing element against the sheet stream is exceeded.

13. The monitoring apparatus according to claim 1, which comprises at least one first sensor system for determining a deflection of said sensing element from a rest position and at least one second sensor system for determining a bending of said leaf spring, and at least one of said first and second sensor systems is a measuring system selected from the group consisting of a distance measuring system and a force measuring system.

14. The monitoring apparatus according to claim 13, wherein said distance measuring system is an inductive distance measuring system.

15. The monitoring apparatus according to claim 13, which comprises a control and regulating device connected to said first and second sensor systems and configured to drive said actuating drive.

16. The monitoring apparatus according to claim 15, which comprises a housing enclosing said actuating drive and said control and regulating device.

17. The monitoring apparatus according to claim 15, wherein said control and regulating device, said first and second sensor system, said sensing element, and said actuating drive form an intelligent sensor.

18. The monitoring apparatus according to claim 17, wherein said sensor is configured to detect sheet formations selected from the group consist of double sheets, premature sheets, delayed sheets, skewed sheets, and missing sheets and to carry out a thickness measurement on an individual sheet or on the sheet stream.

19. The monitoring apparatus according to claim 1, wherein said sensing element is arranged above or beneath the sheet stream.

20. In combination with a feeder of a sheet-feed printing machine, a monitoring apparatus for a sheet feed to the sheet-fed printing machine having a sheet stream traveling in a given sheet stream direction, comprising:

at least one sensing element disposed adjacent the sheet stream; and an actuating device connected to said sensing element for selectively displacing said sensing element towards and away from the sheet stream, said actuating device having an actuating drive for displacing said sensing element, said actuating drive including at least one piezoelectric actuator.

21. A method of monitoring a sheet stream structure or a sheet stream being transferred into a sheet-processing machine, which comprises:

transporting a stream of sheets across a back-pressure element and towards a sheet-processing machine;

displacing at least one sensing element in a direction towards the back-pressure element over which the stream of sheets is guided in the form of an overlapping sheet stream or a sheet stream having individual sheets;

detecting, with the sensing element set against the sheet stream, the sheet stream as it is transferred into the sheet-processing machine; and thereby displacing the sensing element with respect to the sheet stream in dependence on an instantaneous sheet stream thickness such that a pressing force with which the sensing element is pressed against the sheet stream is maintained within a predefined range.

22. The method according to claim 21, which comprises maintaining the pressing force at a predefined value.

23. The method according to claim 21, which comprises monitoring the pressing force of the sensing element against the sheet stream, and, if the value falls above or below a respective threshold value, triggering a fault signal.

24. A method of monitoring a sheet stream structure or a sheet stream being transferred into a sheet-processing machine, which comprises:

transporting a stream of sheets across a back-pressure element and towards a sheet-processing machine;

displacing at least one sensing element in a direction towards the back-pressure element over which the stream of sheets is guided in the form of an overlapping sheet stream or a sheet stream having individual sheets;

detecting a sheet stream structure with the sensing element in contact at a start of the sheet transfer;

determining a height profile of the sheet stream from information obtained in the sheet stream detecting step;

setting the sensing element away from the sheet stream and, during a further transfer of the sheet stream, continuously displacing the sensing element in the direction of the sheet stream and in the opposite direction such that a clear spacing between the sensing element and the sheet stream is substantially constant; and if a fault in the sheet stream is detected, outputting a fault message.

25. The method according to claim 24, which comprises displacing the sensing element in oscillatory motion in dependence on a speed of the sheet-processing machine, so as to monitor a contour or the height profile of the sheet stream without contact.

26. The method according to claim 24, which comprises transporting the sheets in a sheet stream with individual sheets, and dipping the sensing element, in a first end position, into at least one clearance formed between a preceding sheet and a sheet following immediately at a distance.

27. The method according to claim 24, which comprises transporting the sheets in a scaled sheet stream with overlapping sheets, and dipping the sensing element, in a first end position, into at least one depression located between a trailing edge of a preceding sheet and a trailing edge of a following sheet overlapped by the preceding sheet.

28. The method according to claim 27, which comprises dipping the sensing element into every depression.

* * * * *